US006920228B2

(12) United States Patent
Redmer et al.

(10) Patent No.: US 6,920,228 B2
(45) Date of Patent: Jul. 19, 2005

(54) LIGHTWEIGHT HEADSET FOR HIGH NOISE ENVIRONMENTS

(75) Inventors: Karl W. Redmer, Hampshire, IL (US); John A. Towns, St. Charles, IL (US); Gene H. Jones, Palatine, IL (US)

(73) Assignee: Otto Engineering, Inc., Carpentersville, IL (US)

( * ) Notice: Subject to any disclaimer, the term of this patent is extended or adjusted under 35 U.S.C. 154(b) by 197 days.

(21) Appl. No.: 10/224,200

(22) Filed: Aug. 20, 2002

(65) Prior Publication Data

US 2004/0037444 A1 Feb. 26, 2004

(51) Int. Cl.[7] ..... H04R 25/00

(52) U.S. Cl. ..... 381/370; 381/374; 381/381; 381/382

(58) Field of Search ..... 381/370, 371, 381/374, 375, 376, 377, 378, 379, 380, 381, 382, 338; 181/20, 21, 22, 129, 130, 135

(56) References Cited

U.S. PATENT DOCUMENTS

| | | | | |
|---|---|---|---|---|
| 2,566,313 A | * | 9/1951 | Cates | 181/22 |
| 2,586,644 A | * | 2/1952 | Gilbert | 381/382 |
| 3,184,556 A | | 5/1965 | Larkin | |
| 3,548,118 A | | 12/1970 | Hutchings | |
| 3,993,879 A | | 11/1976 | Larkin | |
| 4,039,765 A | | 8/1977 | Tichy et al. | |
| 4,090,042 A | | 5/1978 | Larkin | |
| 4,261,432 A | | 4/1981 | Gunterman | |
| 4,325,453 A | | 4/1982 | Moussette | |
| 4,335,281 A | | 6/1982 | Scott et al. | |
| 4,347,911 A | | 9/1982 | Bertagna et al. | |
| 4,420,657 A | | 12/1983 | Larkin | |
| 4,528,689 A | | 7/1985 | Katz | |
| 4,588,868 A | | 5/1986 | Bertagna et al. | |
| 4,617,431 A | | 10/1986 | Scott et al. | |
| 4,875,233 A | | 10/1989 | Derhaag et al. | |
| 4,926,961 A | | 5/1990 | Gattey et al. | |
| 4,932,052 A | | 6/1990 | Lo | |
| 5,260,997 A | | 11/1993 | Gattey et al. | |
| 5,369,857 A | | 12/1994 | Sacherman et al. | |

(Continued)

OTHER PUBLICATIONS

Plantronics Products + Accessories Guide, Spring 2002.
Plantronics Brochure entitled "DuoPro Telephone Headset Family," Jul. 1, 2002.
Web page for Lectret Tactical Headset SH–05; printed from the Intranet on Aug. 14, 2002.
Web page for Motorola Professional Headset with Swivel Boom Microphone—53740; printed from the Internet on Sep. 14, 2001.
Web page for Plantronics Products for Cordless and Mobile applications; printed from the Internet on Sep. 14, 2001.
Web page for EarTec Micro headset, printed from the Internet on Sep. 14, 2001.
Web page for EarTec Helmet headset, printed from the Internet on Sep. 14, 2001.

*Primary Examiner*—Huyen D. Le
(74) *Attorney, Agent, or Firm*—McAndrews, Held & Malloy, Ltd.

(57) ABSTRACT

A lightweight communications headset includes a headband adapted to be worn on user's head. A speaker housing is carried by the headband and defines an acoustic chamber. A speaker mounted within projects sound waves into the acoustic chamber. The headband carries a pair of earpieces which are positionable adjacent to the user's ears for delivering sound thereto. The acoustic chamber is coupled to earpieces through acoustic passages which transmit sound waves produced in the acoustic chamber to the earpieces. The earpieces preferably include removable in-ear inserts, which may be constructed for insertion into the auditory canals of the user's ears. Since the in-ear inserts are removable, the headset can readily be configured for a variety of applications.

24 Claims, 7 Drawing Sheets

U.S. PATENT DOCUMENTS

| | | | |
|---|---|---|---|
| 5,381,486 | A | 1/1995 | Ludeke et al. |
| 5,450,496 | A | 9/1995 | Burris et al. |
| 5,533,122 | A | 7/1996 | Gattey et al. |
| D375,500 | S | 11/1996 | Bungardt et al. |
| D375,959 | S | 11/1996 | Davis et al. |
| D377,020 | S | 12/1996 | Bungardt et al. |
| D381,336 | S | 7/1997 | Bungardt et al. |
| 5,712,453 | A | 1/1998 | Bungardt et al. |
| D394,437 | S | 5/1998 | Landreth et al. |
| 5,761,298 | A | 6/1998 | Davis et al. |
| D403,327 | S | 12/1998 | Landreth et al. |
| 5,960,094 | A | 9/1999 | Jensen et al. |
| 6,097,827 | A | 8/2000 | Yang |
| D439,890 | S | 4/2001 | Skulley et al. |
| D449,295 | S | 10/2001 | Smith et al. |
| D455,417 | S | 4/2002 | Bey et al. |
| D455,732 | S | 4/2002 | Skulley et al. |
| D457,155 | S | 5/2002 | Skulley et al. |
| D458,248 | S | 6/2002 | Davies et al. |
| 2002/0096391 | A1 | 7/2002 | Smith et al. |
| 2002/0181729 | A1 | 12/2002 | Smith |

* cited by examiner

LIGHTWEIGHT HEADSET FOR HIGH NOISE ENVIRONMENTS

RELATED APPLICATIONS

[Not Applicable]

FEDERALLY SPONSORED RESEARCH OR DEVELOPMENT

[Not Applicable]

[MICROFICHE/COPYRIGHT REFERENCE]

[Not Applicable]

BACKGROUND OF THE INVENTION

Communication headsets are used in a wide variety of communications equipment such as telephones, two-way radios, cellular telephones, personal audio systems, etc. In the past, the design of the headset has typically been dictated by its intended operating environment. For example, in high noise environments, such as construction applications, factories, and auto racing, it is typically desirable to isolate against ambient noise. For this reason, headsets for high noise environments traditionally consist of heavy frames that support ear cups. The ear cups surround the exterior of the user's ear and contain individual speaker elements for each ear and noise attenuation material to insulate against external noise. Noise attenuation is dependent on the headset applying pressure on the user's head to seal the ear cups tightly around the user's ears. However, various forms of headgear and eyeglass worn by the user can prevent proper sealing of the ear cups, thereby eliminating the noise isolation capabilities of the headset. In addition, these headsets are bulky and uncomfortable to wear. This is particularly true in hot and humid environments because the ear cups tend to trap and retain heat and moisture. In addition, such headsets generally cannot be converted for use in lower noise environments, where it may be desirable for the user to be able to hear ambient sounds while wearing the headset.

A variety of lightweight headset designs are also known which are specifically designed for use in low noise environments, such as offices and homes. However, many lightweight headsets only provide audio for only one ear, without the option of having audio delivered to both ears. Such designs are not suitable for high-noise environments because they do not isolate the user's ears against ambient noise. In addition, many lightweight headsets are physically supported only by the user's ear. Besides being uncomfortable, such designs are easily dislodged from the user during use, particularly when the user wears glasses. Some lighter weight headsets do deliver sound to both ears. However, known designs utilize separate speakers for each ear, which increases the weight of the headset, thereby making the headset less comfortable to wear.

BRIEF SUMMARY OF THE INVENTION

A lightweight communications headset includes a headband adapted to be worn on the user's head. A speaker housing is carried by the headband and defines an acoustic chamber. A speaker is adapted to convert electrical signals to sounds which are directed into the acoustic chamber. The speaker can be either a magnetic or dynamic speaker. The headband carries a pair of earpieces which are positionable adjacent to the ears of the user for delivering sound thereto. Acoustic passages extend between the acoustic chamber and earpieces for transmitting sound therebetween.

A signal delivery means delivers electrical signals to the speaker. The signal delivery means may include at least one electrical conductor having a first end electrically connected to the speaker and a second end connectable to a remote device. Alternatively, the signal delivery means may, for example, include a radio/receiver for receiving signals from a transmitter device.

The earpieces preferably include in-ear inserts, which may be constructed for insertion into the auditory cannals of the user's ears. The ear inserts are preferably removably connected to the headset to allow them to be replaced, and to permit a variety of different inserts to be used with the headset. The earpieces are also removable to allow the headset to be configured for delivering sound to either or both ears.

According to one embodiment, the headband is arcuate and is configured to extend around the back of the user's head. The speaker housing mounted on the headband such that it is positioned at the back of the user's head during use. The headband may carry temple pieces, positioned to engage the user's temples and support the headband on the user's head.

The headband may be constructed of a flexible wire frame which is generally C-shaped and is configured to fit around the back of the user's head. The frame may also include arcuate portions formed to fit over and be supported by the user's ears.

The headset may include a microphone boom having a first end connected to the headband and a second end positionable proximate to the user's mouth. A microphone element is carried by the second end of the microphone boom and is adapted to convert auditory sounds to electrical signals. A signal delivery means is provided for delivering electrical signals from the microphone element to a remote device. The signal delivery means may include at least one electrical conductor having a first end electrically connected to the microphone and a second end extending from the speaker housing for connection to a remote device.

Figure 1:
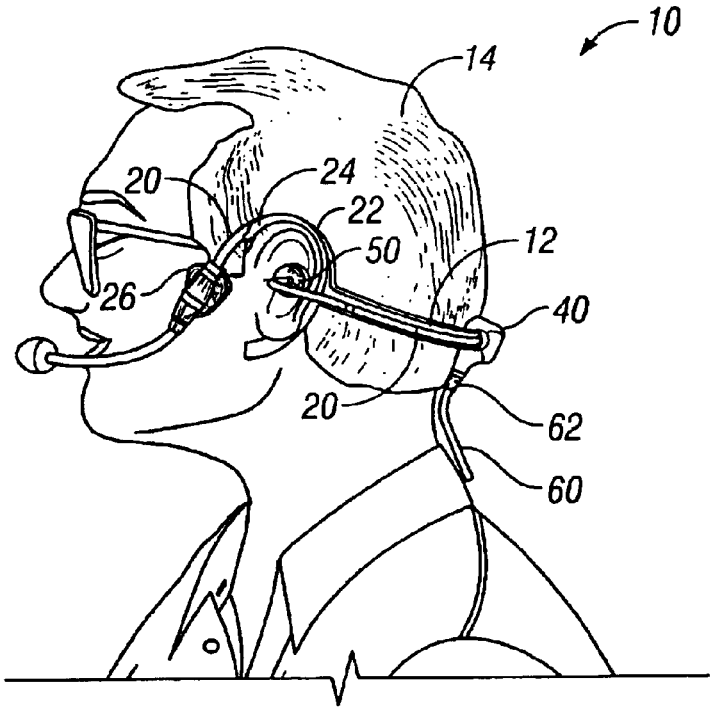
FIG. 1 is a front perspective view of a headset according to certain aspects of an embodiment of the present invention, illustrating the headset in use.
Figure 2:
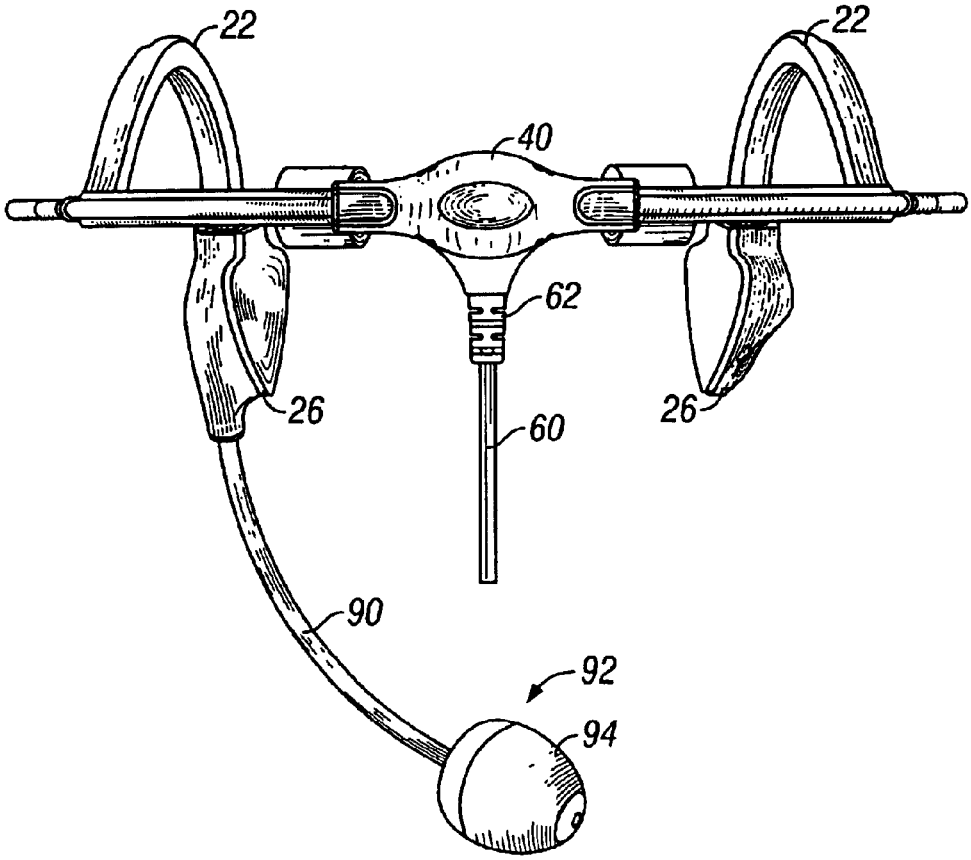
FIG. 2 is a rear elevation view of the headset of FIG. 1.
Figure 3:
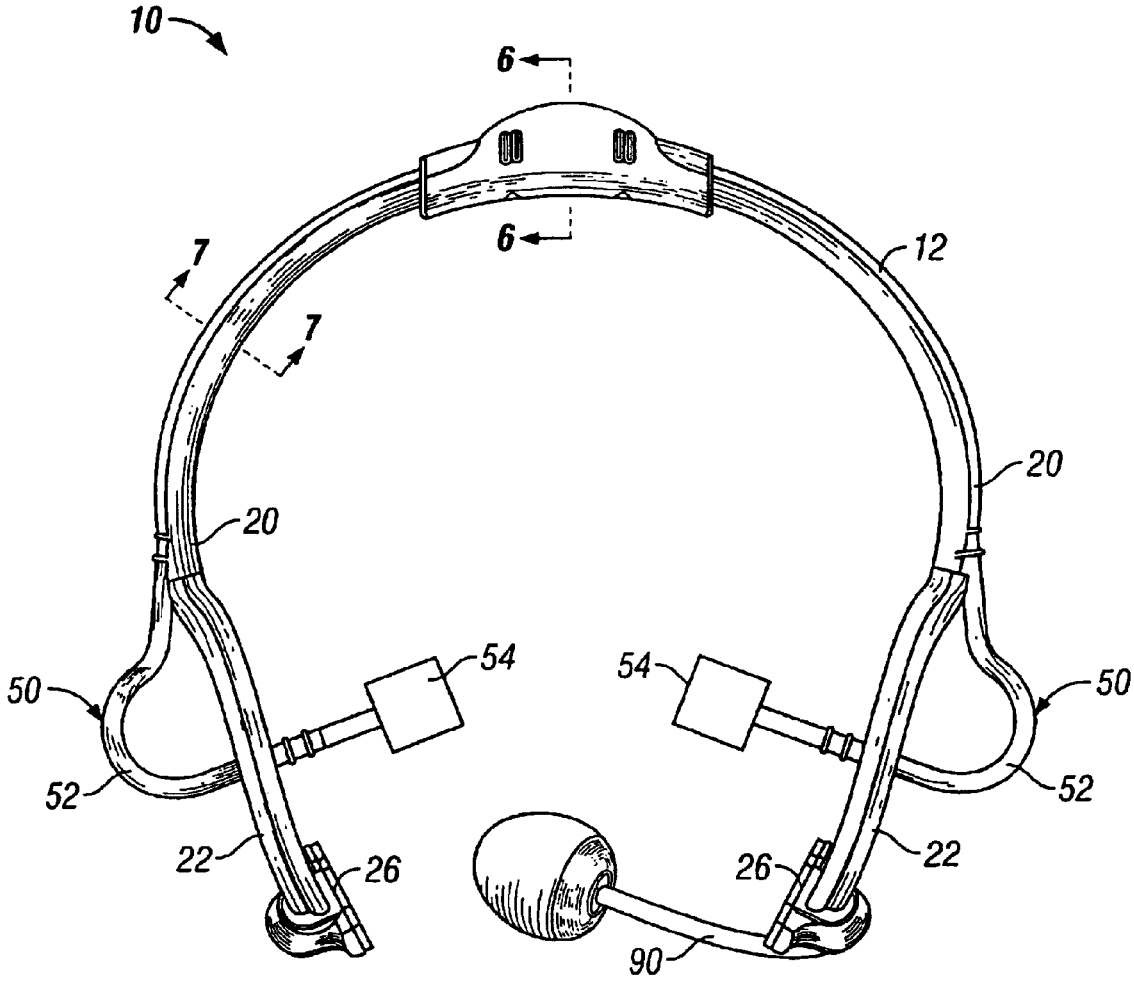
FIG. 3 is a top elevation view of the headset of FIG. 1.
Figure 4:
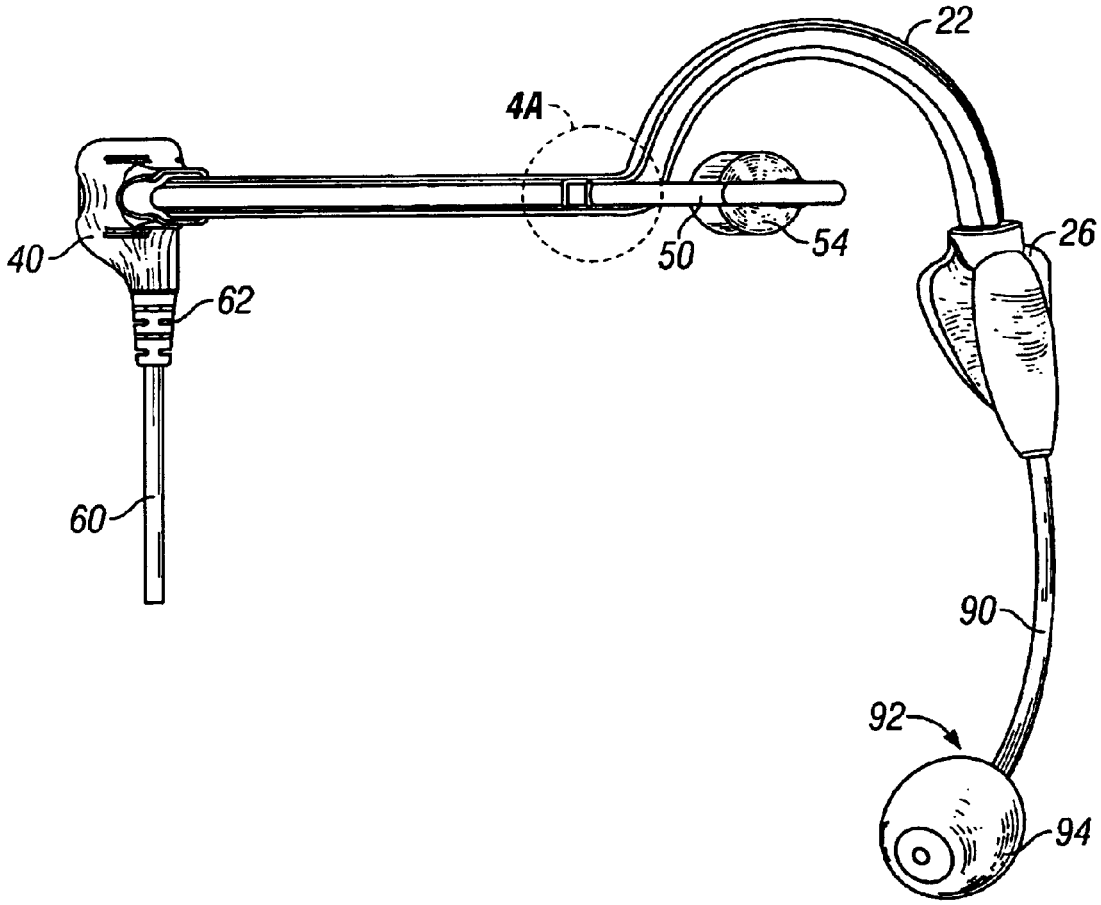
FIG. 4 is a side elevation view of the headset of FIG. 1.
Figure 4A:
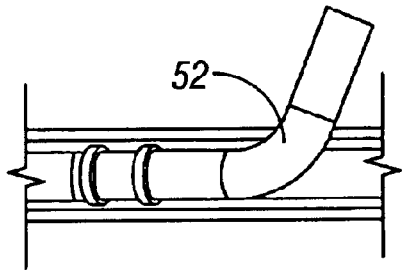
FIG. 4A is an enlarged view of a portion of FIG. 4.

The foregoing summary, as well as the following detailed description of the preferred embodiments of the present invention, will be better understood when read in conjunction with the appended drawings. For the purpose of illustrating the preferred embodiments of the present invention, there is shown in the drawings, embodiments which are presently preferred. It should be understood, however, that the present invention is not limited to the arrangements and instrumentality shown in the attached drawings.

DETAILED DESCRIPTION OF THE INVENTION

Referring to the drawings, a lightweight communications headset 10 includes a flexible headband 12 adapted to be worn on the head 14 of a user. In the illustrated embodiment, the headband 12 is configured to extend around the back of the user's head 14. However, it will be appreciated that the headband 12 could be constructed to extend over the crown or the user's head, for example.

Figure 5:
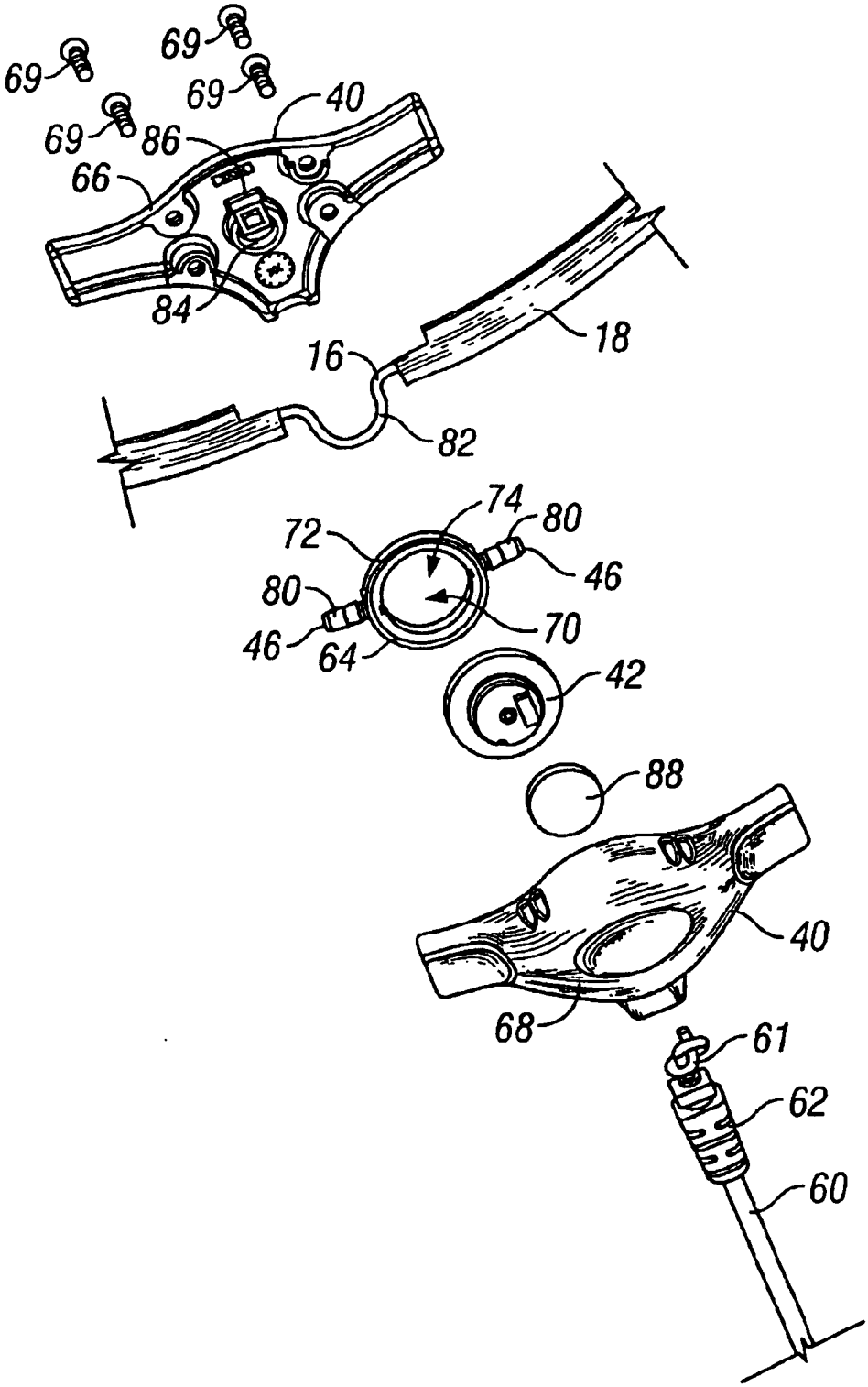
FIG. 5 is a partial exploded view of a speaker housing employed in the headset of FIG. 1.

As can be seen in FIG. 5, the headband 12 includes a flexible wire frame 16 on which the other components of the headset 10 are supported. A polymeric housing 18 is molded or extruded around at least a portion of the wire frame 16. The headband 12 is generally C-shaped and is configured to fit around the back of the user's head 14. Flexible legs 20 extend forward and around the sides of the user's head 14. The flexible legs 20 are adapted to expand outwardly relative to one another so that the headset 10 can be used with a variety of head sizes. The flexible wire frame 16 can be adjusted by hand, e.g., by bending the wire frame 16, to customize the fit for the individual user. Alternate size frames can also be made for larger users. The legs 20 include arcuate portions 22 formed to fit over and be supported by the user's ear 24.

Figure 8:
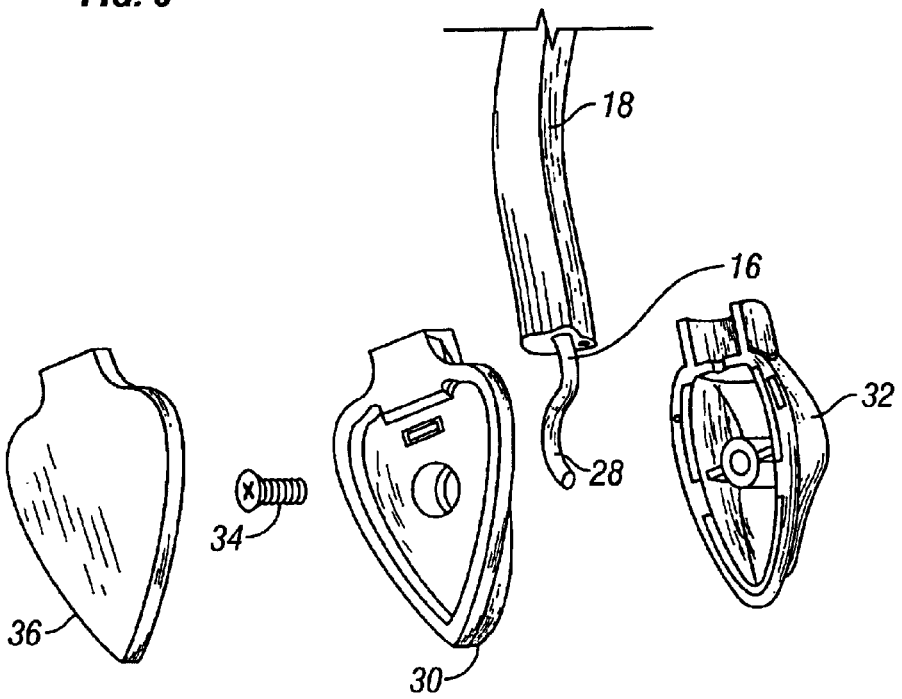
FIG. 8 is a partial exploded view illustrating a temple support employed in the headset of FIG. 1.
Figure 9:
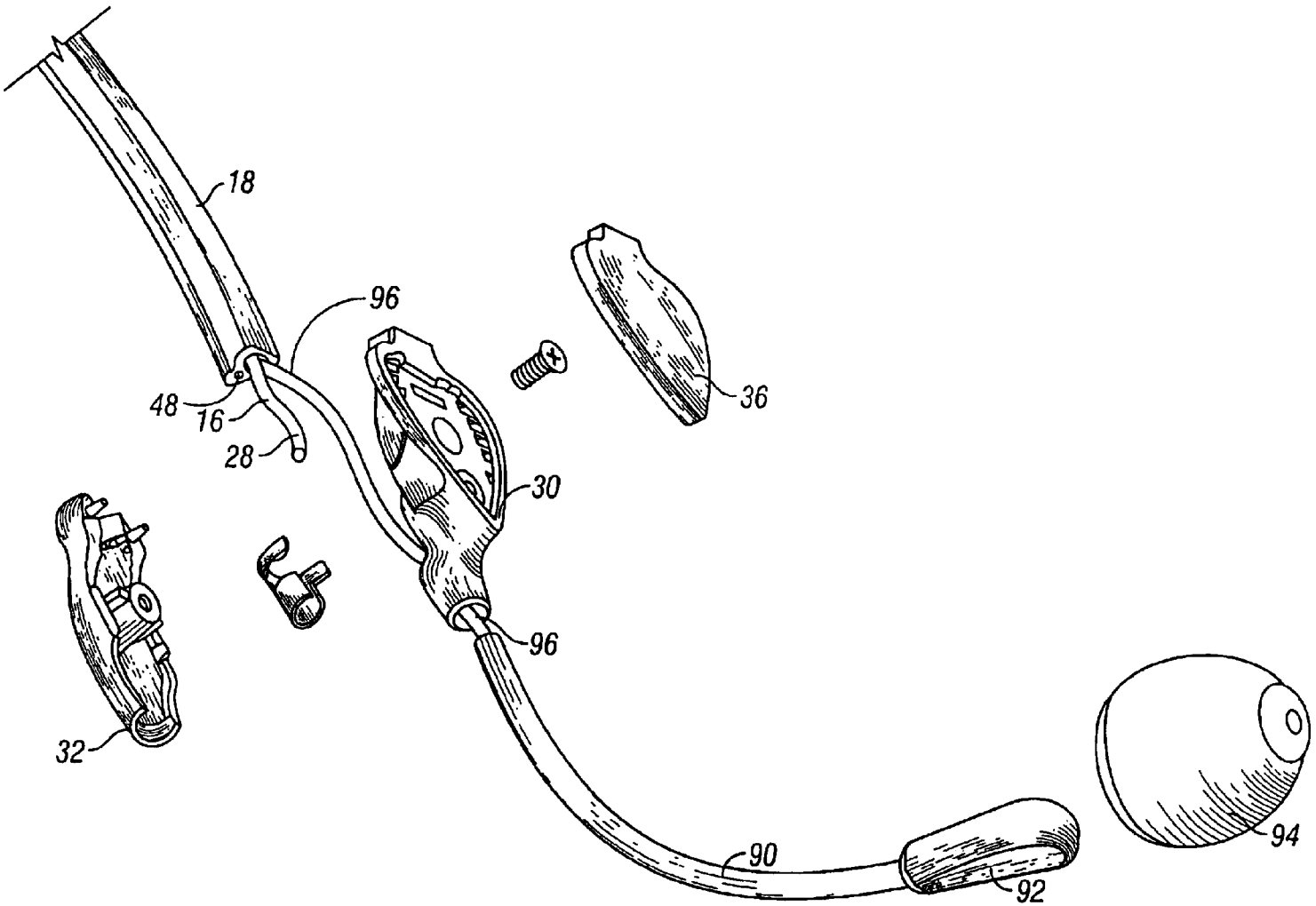
FIG. 9 is a partial exploded view illustrating a temple support which is configured to carry a microphone boom.

Temple supports 26 carried on the ends of the legs 22 engage against the user's temples to support the headset 10 on the user's head. For this purpose, the ends of the wire frames 16 extend distally beyond the housing 18 and terminate in arcuate portions 28. (See FIGS. 8 and 9). The temple supports 26 include first and second portions 30, 32 configured to clamp around the arcuate portions 28 of the wire frame 16. A fastener 34 extends through the first portion 30 and into threads into a reciprocal aperture in the second mating portion 32 to secure the first and second mating portions together. Recesses in the first and second mating portions 30, 32 engage around the wire frame 16 to fix the position of the temple support 26 relative to the frame 16. It will be appreciated, however, that the temple supports 26 could alternatively be constructed to rotate relative to the frame 16. For example, the ends of the frame 16 could terminate in balls configured to engage in reciprocal sockets formed in the temple supports. A foam pad 36 secured, e.g., by adhesive, to the inner face of the temple support first portion 30 engages against the user's temple.

A speaker housing 40 is centrally mounted between the legs 20 of the frame. In use the speaker housing 40 rests against the back of the user's head 14. The speaker housing 40 supports a speaker 42 and it defines a sealed, tuned acoustic compartment or chamber 44 (see FIG. 6). The speaker can be either a magnetic or dynamic speaker. Using a dynamic speaker is advantageous from a cost perspective, particularly in applications such as 2-way radios where power consumption is not a significant concern. The speaker 42 receives input signals and converts them to sound waves which are projected into the acoustic chamber 44. As is explained in greater detail below, the output of the speaker 42 is modified by the acoustic chamber 44 and is directed to the user's ears through acoustic passages 48 which extend between the acoustic chamber 44 and earpieces 50 positioned adjacent to the user's ears 24.

The acoustic passages 48 are defined in part by passages formed in the housing 18 that extends along the headband 12. One end of a given acoustic passage 48 is interconnected with the acoustic chamber 44 and the other end of the acoustic passage 48 is interconnected with the earpiece 50 for delivering sound waves thereto.

The earpiece 50 includes a tubular portion 52 and an ear insert 54. The tubular portion 54 has a first end configured to mate with the acoustic passage 48 and a second end configured to support the ear insert 54. The tubular portion 52 defines a lumen or passage which extends between the acoustic passage 48 and a sound port in the insert 54 for transmitting sound to the user's ear canal. For this purpose, the first end of the tubular portion 52 has a male connecter in the form of a barbed acoustic connector (not shown) which is configured for insertion into the end of the acoustic passage 48. The second end of the tubular member 52 also carries a barbed acoustic connector (not shown) which is configured for insertion into an opening in the ear insert 54. As will be appreciated, the housing 18 and the earpiece 50 function to define an acoustic passage which delivers sound generated in the acoustic chamber to a location proximate to the user's ear. In the illustrated embodiment, the housing 18 and the earpieces 50 are separately formed to allow the headset to be used in a variety of configurations, as discussed below. Alternatively, the housing 18 and earpieces 50 could be integrally formed with on another, e.g., by a continuous extrusion of or section of tubing.

Figure 10:
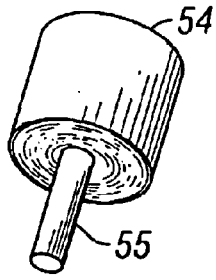
FIGS. 10–12 illustrate alternative ear inserts that can be used in connection with the headset.
Figure 11:
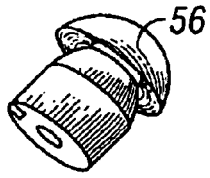
Figure 12:
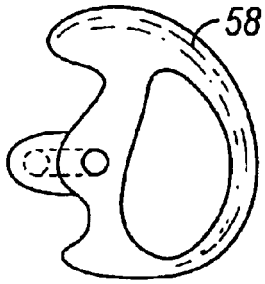
Figure 13:
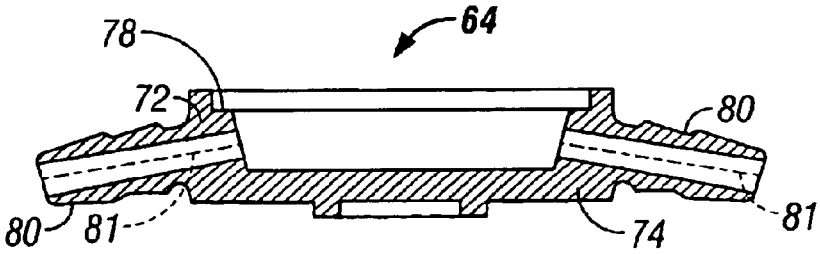
FIG. 13 is a cross-sectional view of an acoustic coupler employed in the headset of FIG. 1.

A variety of in-ear inserts are connectable to the second end of the tubular member 52. This allows the user to reconfigure the headset 10 for use in a variety of operating environments. For example, in noisy environments high-noise inserts 54 as shown in FIG. 10 can be used to block out background noise. The high-noise inserts 54 are acoustic isolating foam inserts with internal audio tubes 55. The high-noise inserts 54 are designed to be inserted partially into the auditory canal of the user's ear. In lower noise situations such as crowd noise environments, an insert 56 as shown in FIG. 11 can be used. The insert 56 is suitable for environments where less noise attenuation is required. In still quieter environments, low-noise (open ear) inserts 58 as shown in FIG. 12 can be used to allow the user to hear ambient noise in one or both ears. Besides allowing reconfiguration of the headset 10, replaceable ear inserts are also more hygienic than a headset whose components are not replaceable at the user's ears.

The headset 10 can also be configured for use in a single ear by removing one of the earpieces 50 and inserting a plug (not shown) into end of the acoustic passage 48. As will be appreciated, the acoustic passage 48 could also be plugged at its junction with the acoustic chamber 44. Alternatively, one of the in-ear inserts could be removed and the end of the tube 52 capped to block sound delivery to one of the user's ears.

A signal delivery means delivers electrical signals from a remote device, such as a telephone, computer, or audio device, to the speaker 42. In the illustrated embodiment, the signal delivery means includes a cable 60 that carries at least one electrical conductor 61. One end of the conductor 61 is electrically connected to the speaker 42 and the other end is electrically connected with the remote device. A wire pull strain relief 62 extends downwardly from the housing 40 and surrounds the cable 60 in a conventional manner. Alternatively, the headset may be a wireless headset and the signal delivery means may comprise a receiver which receives input signals from a remote device, such as a telephone base unit for example, and delivers them to the speaker 42 for conversion into audible sounds.

In operation electrical input signals are transmitted to the speaker 42 via the conductor 61. The speaker 42 converts the signals into sound waves that are projected in the acoustic chamber 44. Sound waves from the acoustic chamber 44 are transmitted out of the ports 46, through the acoustic passages in the housing 18, through the acoustic passages in the earpieces 50, and into the user's ears.

Figure 6:
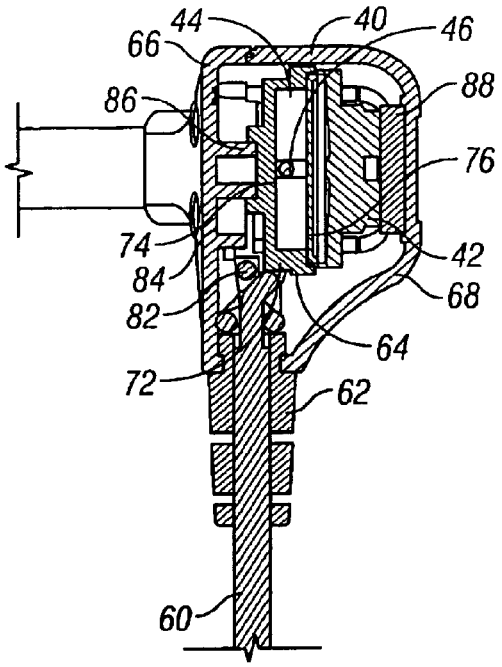
FIG. 6 is a cross-sectional view of the speaker housing along line A—A of FIG. 3.
Figure 7:
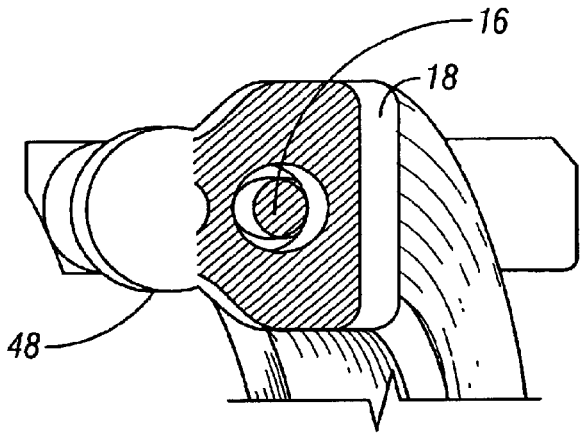
FIG. 7 is a cross-sectional view along line B—B of FIG. 3.

Referring to FIGS. 5 and 6, the speaker assembly includes the speaker housing 40, an acoustic coupler 64, and the speaker 42. The housing 40 consist of first and second mating portions 66, 68, which are configured to be secured together around the wire frame 16. Fasteners 69 extend through apertures in the housing first portion 66 and thread into the housing second portion 68 to secure the housing portions 66, 68 together. Alternative means, such as a snap-fit, adhesives, sonic welding, could be used to secure the housing sections together. The housing portions 66, 68 also encapsulate the acoustic coupler 64 and the speaker 42 and fix their positions relative to one another.

The acoustic coupler 64 is generally cup-shaped and it includes a front opening 70, an annular side wall 72, and a back wall 74. The face 76 of the speaker 42 is sized for insertion into the front opening 70 of the acoustic coupler 64. An annular flange 78 projects inwardly from the side wall and abuts against the face 78 of the speaker 42 to fix its position relative to the coupler 64.

The acoustic chamber 44 is generally defined by the space bounded by the side wall 72, the back wall 74 and the face 76 of the speaker 42. Sound waves emanating from the face 78 of the speaker 42 are projected into the chamber 44. The chamber 44 is tuned (by varying its depth and diameter) to obtain the desired frequency performance from the headset 10. As will be appreciated, the frequency performance is dependant on user preferences and the intended operating environment of the customer. Typically, the chamber 44 will be constructed to transmit frequencies in the radio range of 300 to 3000 Hz. The exact dimensions required to transmit the desired frequency range is empirically determined by varying the depth, shape, and size of the acoustic chamber 44. It will be appreciated that the acoustic coupler 64 could be integrally formed with the speaker housing, e.g., in the housing first portion 66. However, by forming the acoustic coupler 64 separately, the headset 10 can readily be customized for a particular application by varying the depth and/or diameter of the chamber 44.

A pair of barbed acoustic fittings 80 extend outwardly from the acoustic coupler 64 and are configured and positioned for insertion into ends of the acoustic passages 48. The fittings 80 define lumens or passages 81 that transmit sounds generated in the acoustic compartment to the acoustic passages 48 in the housing 18.

The wire frame 16 includes a U-shaped bend 82 at the junction of the first and second legs 22. The U-shaped bend 82 is captured between the speaker housing portions 66, 68. As can be seen in FIG. 5, a post 84 or protrusion extends inwardly from the inner face of the housing first portion 66 and through the U-shaped bend 82. When forces are exerted on the cable 60, the interface between the post 84 and the U-shaped bend 82 serves to direct these forces to the wire frame 16, as opposed to the interconnection between the conductors 61 and the speaker 42. In particular, if the cable 60 is pulled downwardly, the force is transmitted through the wire pull strain relief 62, to the speaker housing 40, and in turn to the wire frame 16 through its interface with the post 84.

A second post or protrusion 86 extends from the inner face of the housing first portion 66 and mates with a reciprocal recess formed in the acoustic coupler 64. The post 86 serves to fix the position of the acoustic coupler 64 within the speaker housing 40.

A compressible member 88, made from a material such as a compressible rubber or foam, is interposed between the speaker 42 and the second portion 68 of the speaker housing 40. When the housing portions 66, 68 are fastened together, the member 88 is compressed between the speaker 42 and the housing second portion 68, thereby fixing the positions of speaker 42 and the acoustic coupler 64 within the housing 40.

The headset 10 may also include a microphone boom 90 having a first end connected to the headband 12 and a second end positionable proximate to the user's mouth. A conventional microphone 92 is carried by the second end of the microphone boom 90 and is adapted to convert auditory sounds into electrical signals. A foam cover 94 is mountable over the microphone. A signal delivery means is provided for delivering electrical signals from the microphone 92 to a remote device. The signal delivery means may include at least one electrical conductor 96 having one end electrically connected the microphone 92 and a second end connectable to a remote device, e.g., via a conventional connector (not shown). The conductor 96 is routed from the microphone 92 through the microphone boom 70, into the temple support 26, through the housing 18, and into the speaker housing 40. The conductor 66 extends out of the housing, through the wire pull strain relief and has a second end which is interconnected with a remote device (not shown), e.g., through a connector (not shown).

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A lightweight communications headset adapted to deliver sounds to the ears of a user, comprising a headband configured to be worn on user's head;

first and second temple pieces carried by the headband, the temple pieces being configured to engage the user's temples and support the headband on the user's head;

a speaker housing carried by said headband and defining an acoustic chamber;

a speaker adapted to convert electrical signals to sound waves which are projected into the acoustic chamber;

first and second earpieces carried by the headband and being positionable adjacent to an ear of the user for delivering sound thereto; and sound transmitting passages extending between the acoustic chamber and the earpieces for transmitting sound therebetween.

2. A lightweight headset as set forth in claim 1, wherein the earpieces comprise removable ear inserts.

3. A lightweight headset as set forth in claim 2, wherein the ear inserts are constructed for partial insertion into the user's auditory canal.

4. A lightweight headset as set forth in claim 1, wherein the headband is arcuate and is configured to extend around the back of the user's head.

5. A lightweight communications headset as set forth in claim 1, wherein said headband comprises a flexible wire frame.

6. A lightweight communications headset as set forth in claim 5, wherein said flexible wire frame is generally C-shaped and is configured to fit around the back of the user's head.

7. A lightweight headset as set forth in claim 5, wherein the flexible wire frame includes arcuate portions formed to fit over and be supported by the user's ears.

8. A lightweight communications headset as set forth in claim 1, wherein at least one of said earpieces is removable so that the headset can be configured to deliver sound to only one ear of the user.

9. A lightweight communications headset as set forth in claim 1, further comprising signal delivery means for delivering electrical input signals to the speaker.

10. A lightweight headset as set forth in claim 9, wherein the signal delivery means comprises at least one electrical conductor having a first end electrically connected to the speaker and a second end connectable to a remote device.

11. A lightweight headset as set forth in claim 1, further comprising:

a microphone boom having a first end connected to the headband and a second end positionable proximate to the user's mouth;

a microphone carried by the second end of the microphone boom and being adapted to convert auditory sounds to electrical signals; and second signal delivery means for delivering electrical signals from the microphone element to a remote device.

12. A lightweight headset as set forth in claim 11, wherein said second signal delivery means comprises at least one electrical conductor having a first end electrically connected to the microphone and a second end connectable to a remote device.

13. A lightweight headset as set forth in claim 1, wherein the first and second temple pieces each comprise a foam pad configured to engage against a user's temple.

14. A lightweight communications headset adapted to deliver sounds to the ears of a user, comprising a headband configured to be worn around a user's head, the headband including flexible legs that extend around the sides of the user's head and terminate in temple pieces that are adapted to engage against the user's temples so as to support the headband on the user's head;

a speaker housing carried by the headband and defining an acoustic chamber;

a speaker mounted within the housing and being adapted to convert input signals to sound waves which are projected into the acoustic chamber;

signal delivery means for delivering input signals to the speaker;

first and second earpieces carried by the flexible headband and being positionable to project sounds into the auditory canals of the user's ears; and acoustic passages extending between the acoustic chamber and the earpieces for transmitting sounds therebetween.

15. A lightweight headset as set forth in claim 14, wherein the signal delivery means comprises at least one electrical conductor having a first end electrically connected to the transducer and a second end extending from the speaker housing for connection to a remote device.

16. A lightweight headset as set forth in claim 14 wherein the headband further includes arcuate ear clips which are configured to fit over and be supported by the user's ears.

17. A lightweight headset as set forth in claim 14, wherein the earpieces include removable in-car inserts.

18. A lightweight headset as set forth in claim 14, wherein the earpieces comprise in-ear inserts that are configured for insertion into the auditory canals of the user's ears.

19. A lightweight communications headset as set forth in claim 14, wherein at least one of the earpieces is removable so that the headset can be configured to deliver sound to only one ear of the user.

20. A lightweight headset as set forth in claim 14, further comprising:

a microphone boom having a first end connected to the headband and a second end positionable proximate to the user's mouth;

a microphone element carried by the second end of the microphone boom and being adapted to convert auditory sounds to electrical signals; and second signal delivery means for transmitting electrical signals from the microphone element to a remote device.

21. A lightweight headset as set forth in claim 20, wherein said second signal delivery means comprises at least one electrical conductor having a first end electrically connected to the microphone and a second end extending from the speaker housing for connection to a remote device.

22. A lightweight communications headset adapted to deliver sounds to the ears of a user, comprising a headband configured to be worn on a user's head;

first and second temple pieces carried by the headband, the temple pieces being configured to engage the user's temples and support the headband on the user's head;

a speaker housing carried by the headband and defining an acoustic chamber;

a speaker adapted to convert input signals into sound waves, the speaker being positioned to project sound waves into the acoustic chamber;

signal delivery means for delivering input signals to the speaker;

first and second earpieces carried by the headband, each earpiece including a respective sound port positionable adjacent to an ear of the user for delivering sound thereto;

acoustic passages extending between the acoustic chamber and the first and second earpieces, respectively, for transmitting sounds therebetween; and wherein the first and second earpieces are removably connected to the headband so that the headset can be configured to deliver sound to either or both of the user's ears.

23. A lightweight communications headset adapted to deliver sounds to the ears of a user, comprising a headband configured to be worn on a user's head;

first and second temple pieces carried by the headband, the temple pieces being configured to engage the user's temples and support the headband on the user's head;

a speaker housing carried by the headband and defining an acoustic chamber, the speaker housing comprising first and second mating portions and a cup shaped member defining the acoustic chamber;

a speaker being adapted to project sound waves into the acoustic chamber in response to input signals;

earpieces carried by the headband and being positionable adjacent to the user's ears for delivering sound thereto; and acoustic passages extending between the acoustic chamber and the earpieces for transmitting sound waves generated in the acoustic chamber to the earpieces.

24. A lightweight headset as set forth in claim 23, wherein the earpieces comprise ear inserts.

* * * * *